US005787654A

United States Patent [19]

Drost

[11] Patent Number: 5,787,654

[45] Date of Patent: Aug. 4, 1998

[54] ISOGRID TILE

[75] Inventor: Steve Drost, Salt Lake City, Utah

[73] Assignee: Sport Court, Inc., Salt Lake City, Utah

[21] Appl. No.: 531,926

[22] Filed: Sep. 21, 1995

[51] Int. Cl.[6] ..... E04F 15/16

[52] U.S. Cl. ..... 52/177; 52/180; 52/302.3; 52/403.1; 52/506.01; 52/588.1; 52/591.1

[58] Field of Search ..... 52/177, 302.3, 52/403.1, 581, 588.1, 81.4, 81.5, 591.1, 591.2, 126.5, 126.6, 220.5, 180, 390, 506.01, 650.3, 663; 403/364, 393, DIG. 10

[56] References Cited

U.S. PATENT DOCUMENTS

| | | | |
|---|---|---|---|
| D. 233,832 | 12/1974 | Becker . | |
| D. 238,065 | 12/1975 | Harvey . | |
| D. 255,744 | 7/1980 | Dekko . | |
| D. 274,948 | 7/1984 | Swanson et al. . | |
| D. 327,748 | 7/1992 | Dorfman, Jr. . | |
| 1,472,956 | 11/1923 | Biegler . | |
| 3,439,312 | 4/1969 | Becker et al. | 52/177 |
| 3,723,233 | 3/1973 | Bourke et al. . | |
| 3,909,996 | 10/1975 | Ettlinger, Jr. et al. | 52/177 |
| 4,436,779 | 3/1984 | Menconi et al. . | |
| 4,584,221 | 4/1986 | Kung . | |
| 4,590,731 | 5/1986 | DeGooyer | 52/581 |
| 4,930,286 | 6/1990 | Kotler | 52/177 |

*Primary Examiner*—Carl D. Friedman
*Assistant Examiner*—Timothy B. Kang
*Attorney, Agent, or Firm*—Thorpe, North & Western, L.L.P.

[57] ABSTRACT

A tile for modular flooring assemblies includes a first, second and third pluralities of support ribs which are disposed to intersect and form an isogrid of equilateral support triangles within the tile. The equilateral support triangles provide more even dispersion of loads placed on the tile, and thereby reduce warping and other damage to the tile. Also disclosed is a novel structure for attaching such tiles.

18 Claims, 7 Drawing Sheets

ISOGRID TILE

BACKGROUND OF THE INVENTION

The present invention relates to a tile for use in modular flooring assemblies such as those used for athletic play areas. More particularly, the present invention is related to a modular flooring assembly which improves the dispersion of point loads applied to the floor to prevent deformation and reduce wear on the flooring assembly.

Numerous types of flooring have been used to create playing areas for such sports as basketball and tennis, as well as for other purposes. These flooring assemblies include concrete, asphalt, wood and other materials which have varying characteristics. For each type of flooring, there are corresponding advantages and disadvantages. For example, concrete flooring is easy to construct and provides long term wear. However, the concrete provides no "give" during use and many people are injured each year during sporting events due to falls and other mishaps. Wood floors, such as are used for many basketball courts, have an appropriate amount of give to avoid such injuries. The wood floors, however, are expensive to install and require continued maintenance to keep them in good condition.

Due to these concerns, the use of modular flooring assemblies made of synthetic materials has grown in popularity. The synthetic modular floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location. Examples of modular flooring assemblies include U.S. Pat. No. Des. 274,588; U.S. Pat. No. 3,438,312; U.S. Pat. No. 3,909,996; U.S. Pat. No. 4,436,799; U.S. Pat. No. 4,008,548; U.S. Pat. No. 4,167,599; U.S. Pat. No. 4,226,064 and U.S. Pat. No. Des. 255,744.

A second reason for the popularity of the flooring assemblies is that the durable plastics from which they are formed are long lasting. Unlike other long lasting alternatives, such as asphalt and concrete, the material is generally better at absorbing impacts, and there is less risk of injury if a person falls on the plastic material, as opposed to concrete or asphalt. The connections for the modular flooring assembly can even be specially engineered to absorb lateral force to avoid injuries, as is described in U.S. Pat. No. 4,930,286. Additionally, the flooring assemblies generally require little maintenance as compared to other flooring, such as wood.

One problem which has plagued the modular floor covering assemblies is that of nonuniform response to point load distribution. For example, when a sports ball impacts a tile, its response may vary across the surface of the tile, making ball response unpredictable. Uneven point load distribution on such tiles can also make the floor feel unnatural to those using it. Both of these problems have limited the use of the modular flooring systems. Likewise, premature failure of the flooring tiles also increases the likelihood that the modular flooring will be replaced by other alternatives. Thus, there is needed an improved tile which has a configuration better suited for distribution of load and impact forces and uniform response.

In addition to the need for improved tiles which more evenly distribute load, there is also a need for an improved tile which decreases the risk of warping and other distortions.

SUMMARY OF THE INVENTION

Thus, it is an object of the present invention to provide a tile for modular flooring assemblies which more evenly distributes point loads placed on the tile.

It is another object of the present invention to provide a tile for modular flooring assemblies which is inexpensive and easy to manufacture.

It is yet another object of the invention to provide a modular flooring assembly which includes numerous tiles connected to one another to form a floor, particularly useful for sporting events, which evenly distributes load placed on the modular flooring assembly.

It is still another object of the present invention to provide a new mechanism for connecting a plurality of such tiles to form a floor.

The above and other objects of the invention are realized in specific illustrated embodiments of an isogrid tile including a first plurality of parallel ribs disposed in a first orientation, a second plurality of parallel ribs disposed in a second orientation, transverse to the first orientation, and a third plurality of parallel ribs disposed in a third orientation, transverse to the first and second orientations, such that the first, second and third pluralities of ribs intersect and form a grid defining a plurality of equilateral triangles within the tile.

In accordance with one aspect of the invention, the first, second and third orientations are all disposed in positions offset 60 degrees from one another, and the ribs are intersecting in a common plane.

In accordance with another aspect of the invention, each of the ribs within one of the respective pluralities is spaced less then one inch apart from adjacent ribs within the same plurality. Preferably, the ribs of each plurality will be spaced apart from adjacent ribs of the same plurality between about one-fourth (¼) and three-fourths (¾) of an inch.

In accordance with another aspect of the invention, each of the ribs has an upper edge a adjacent a traffic bearing surface of the tile and may have one or more curvatures or ports formed along the base edge of the rib so that the curvatures or ports define drainage channels between the tile and a floor supporting the tile so as to allow drainage for liquids falling into the equilateral triangles defined by the ribs.

In accordance with another aspect of the invention, the tile includes a plurality of attachment devices for holding a plurality of tiles together. In one embodiment the attachment devices comprise a projecting loop and a male lock or insert member which fits within the projecting loop. The attachment device is resilient to provide lateral absorption of force between the tiles. In another embodiment of the attachment device, the attachment device is formed of a plurality of equilateral triangles formed along the periphery of the tile and a plurality of resilient posts which nest within the triangles so as to provide transfer of force between the modular flooring tiles.

In accordance with still another aspect of the invention, a flat surface layer is attached to an upper end of the ribs so as to provide a generally planar floor surface, while providing the improved load dispersion of the equilateral triangles discussed above.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the appended claims.

Figure 1:
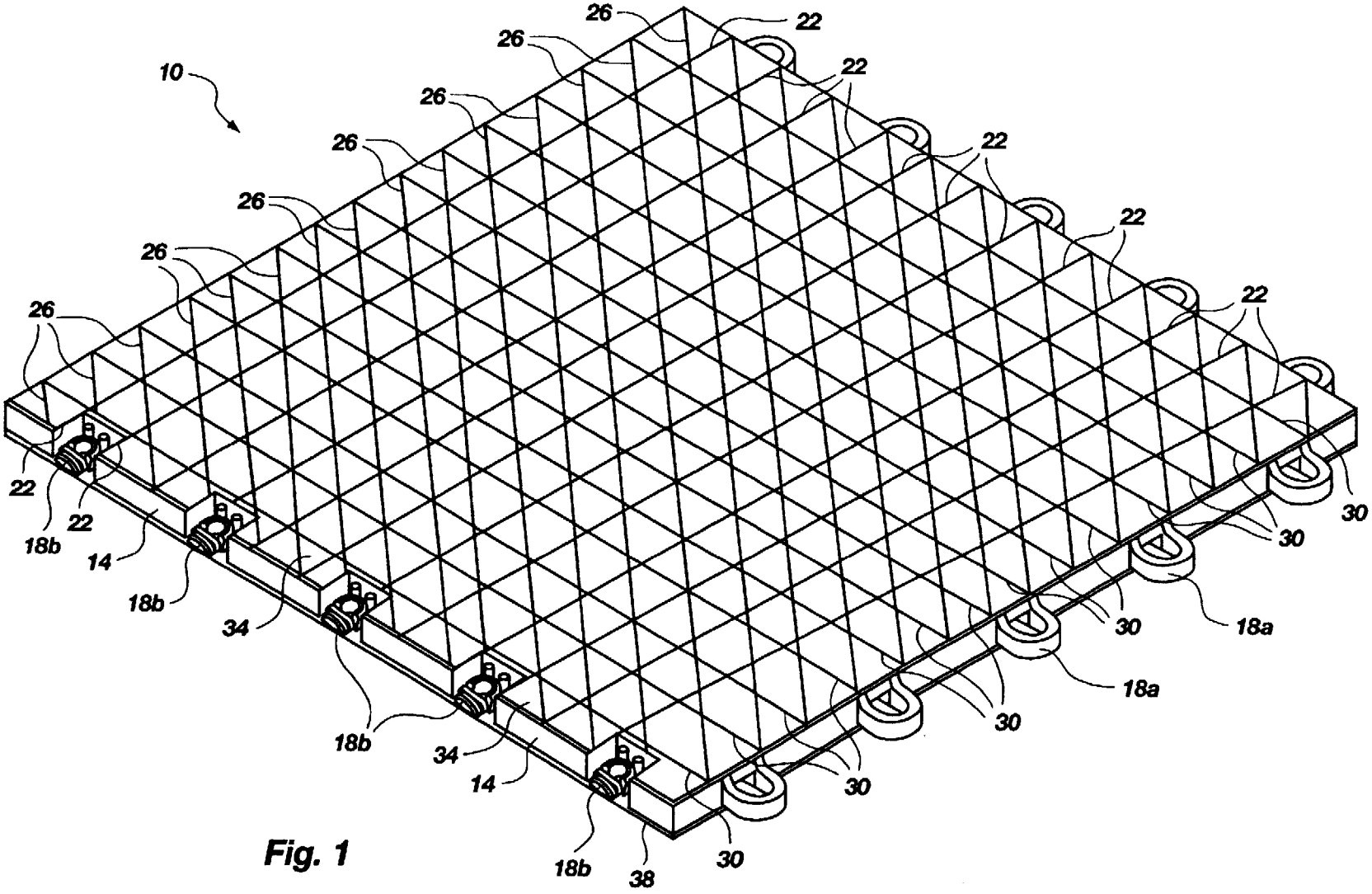
FIG. 1 shows a bottom perspective view of a flooring tile made in accordance with the principles of the present invention.

Referring to FIG. 1, there is shown a bottom perspective view of a flooring tile, generally indicated at 10, made in accordance with the principles of the present invention. The flooring tile 10 has an outer perimeter which is defined by a wall 14. A pair of interlocking attachments, typically a positioning loop 18*a* and a resilient insert 18*b* which nests in the positioning loop, are formed in respective sides of the wall so as to nest with a loop or insert from a tile positioned adjacent the tile 10 in FIG. 1. The positioning loop 18*a* and the insert 18*b* are disposed on the flooring tile 10 to enable a plurality of tiles to be joined together in a single floor assembly, such as a tennis court or basketball court.

While many attachment devices have been taught in the prior art, the specific positioning loop 18*a* and the resilient insert 18*b* shown are preferred because they allow lateral give between the tiles. The lateral give allows for improved absorption of sudden forces, such as those which are common to games like basketball and tennis which involve sudden acceleration and deceleration. A preferred embodiment of the attachment devices is explained in detail in U.S. Pat. No. 4,930,286 which is expressly incorporated herein.

Disposed inside the exterior wall 14 are three groups of, elongate ribs, each rib being disposed in a generally parallel arrangement with other ribs in its respective group. As shown in FIG. 1, a first plurality of elongate ribs 22 is disposed to extend across the modular flooring tile 10.

As the first plurality of ribs 22 extends between the sides of the wall 14, it is intersected by a second plurality of elongate ribs 26. The second plurality of ribs 26 are spaced a similar distance apart from one another as are the first plurality of ribs 22, and are disposed transverse to the first plurality of ribs so as to form a grid. The ribs of the first plurality 22 and the second plurality are typically disposed at an angle of approximately 60 degrees from each other. While the spacing of the ribs relative to other ribs in the same plurality will virtually always be less than 1 inch, it is anticipated that the most common spacing of the ribs will be between about one-third (⅓) and two-thirds (⅔) of an inch.

Intersecting both the first plurality of ribs 22 and the second plurality ribs 26 is a third plurality of ribs 30. The third plurality or ribs 30 includes elongate ribs which are spaced apart a similar distance to the ribs as the first plurality 22 and the second plurality 26. Likewise, the third plurality of ribs 30 are disposed transverse to the second plurality 26 at an angle of about 60 degrees. Thus, the third plurality is also disposed transverse to the first plurality of ribs 22 at an angle of about 60 degrees when measuring in the opposite direction.

By extending from each side of the wall 14 and at the angles indicated, the first, second and third pluralities, 22, 26, 30, respectively, divide the volume between the sides of the wall into a plurality of equilateral triangles, a few of which are indicated at 34. In accordance with the present invention, it has been found that the equilateral triangles 34 formed by the intersecting elongate ribs provide an improved mechanism for distributing load in the tile 10, and therefore an overall flooring assembly. This is especially true for rolling and point loads. The plurality of equilateral triangles 34 better distribute the load, and reduce the risk of damage when heavy loads are rolled over the tile 10.

Also shown in FIG. 1 is a plate or surface member 38. Those skilled in the art will appreciate that in certain applications, the user of the flooring tile 10 will desire a generally planar surface on which to stand or set items, or on which to conduct sporting activities. To accomplish this, a flat surface member 38—typically a synthetic, rubber-like material—is disposed on top of the pluralities of ribs 22, 26 and 30, and extends to a position adjacent to the wall 14 about the periphery of the tile 10.

Many prior art modular flooring assemblies have had considerable problems with deformation. One typical cause is the thermal expansion and contraction of materials placed on the tiles in order to form a generally contiguous surface. Subthermal expansion and contraction may lead to tiles which are warped or otherwise deformed.

To overcome these concerns, the flat surface member 38 will typically be mounted to the grid formed by the equilateral triangles 34 and the wall 14 in a manner similar to that described in U.S. Pat. No. 4,930,286, which has been incorporated herein.

Figure 2:
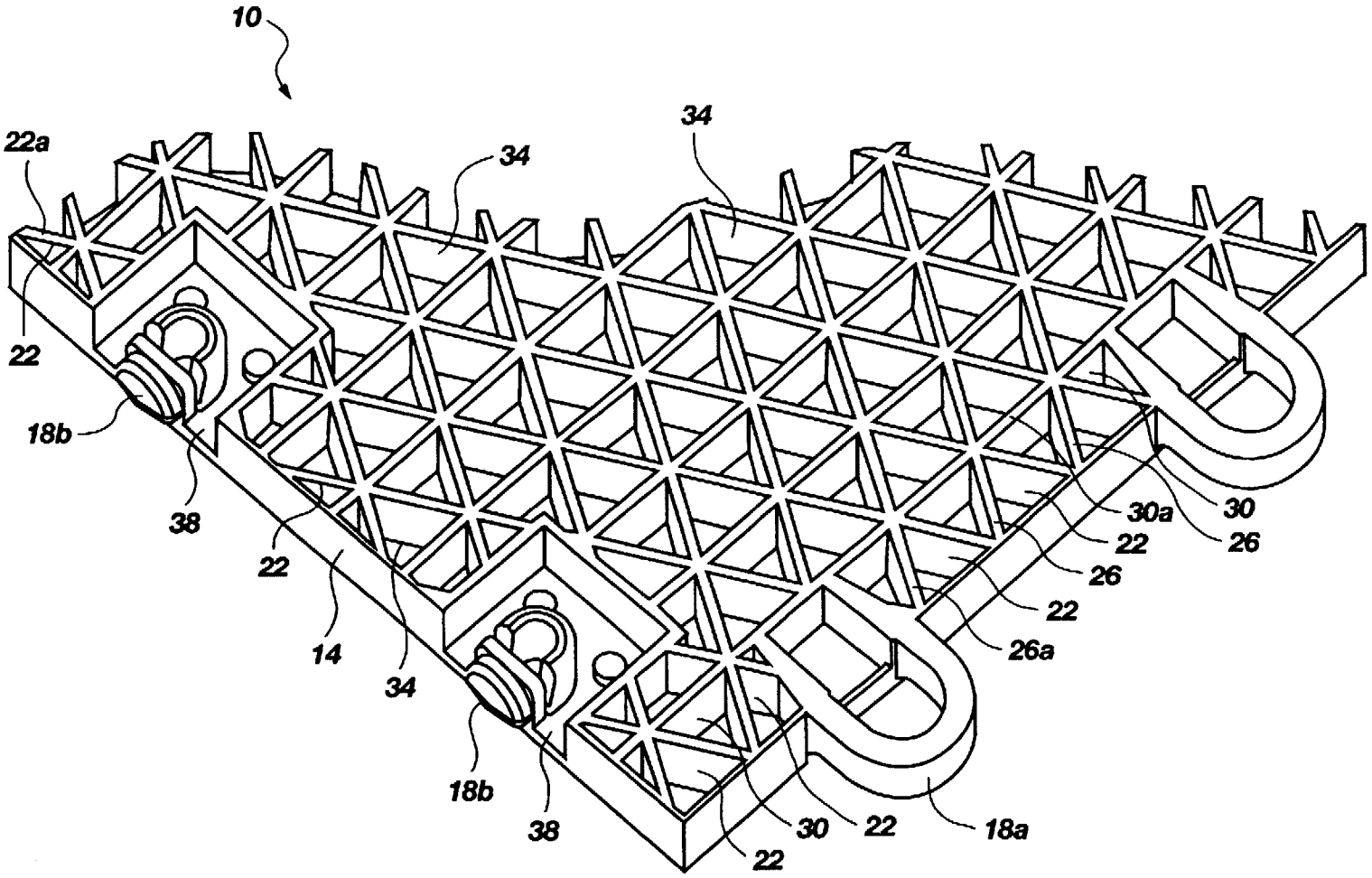
FIG. 2 shows a close-up, fragmented view of the flooring tile shown in FIG. 1.

Referring now to FIG. 2, there is shown a close-up, fragmented view of the tile 10 shown in FIG. 1. Each of the ribs has a thickness of about 0.042 inches at a bottom edge of the rib, identified in FIG. 2 as 22*a*, 26*a* and 30*a*, respectively, and has a three degree draft from the bottom end. In other words, each rib tapers outwardly toward the top end at an angle of about three degrees. Such a draft is especially beneficial when the tiles are molded from a plastic material. The draft allows easy removal of the flooring tile 10 from a mold.

Each rib and the wall 14 will typically be between about one-quarter (¼) of an inch and one inch high, so that the flooring tile 10 is between about one-quarter of an inch and one inch thick. Those skilled in the art will appreciate that the trade-off between mass and height has been a significant concern. While increased mass is beneficial, the taller the walls and ribs, the more the tile is prone to flexing, and thus warping and deformation. This is especially true when a heavy focused load is placed on the tile.

In accordance with the present invention, it has been found that a more optimum height of the tile 10 is achieved between one-quarter (¼) and three-eighths (⅜) of an inch total height for the tile plus the flat surface 38. Typically, the flat surface member 38 will be between 0.060 and 0.125 of an inch thick.

Because of the denser concentration of ribs in a structure using equilateral triangles instead of the traditional square, the tile 10 with a total height of one-quarter (¼) to three-eights (⅜) of an inch has a similar mass to that of conventional half-inch tiles. However, because of the reduced height and the unique intersecting of the first, second and third pluralities of ribs, 22, 26 and 30, respectively, the tile 10 is less prone to flexing, and thus to warping and deformation. The intersection of the ribs in the manner described helps to decrease warping because there is no point on the tile where the tile may warp by warpage within one group of ribs. For example, in a tile having intersecting ribs which form squares, a first plurality of ribs may warp along a line parallel to the second plurality of ribs. Because the warping occurs between the ribs of the second plurality, they provide little or no resistance to the warping. In contrast, the preferred embodiment of the present invention prevents warping because there is no plane along which one plurality can warp without meeting resistance from one or both of the other pluralities. The subject configuration prevents warping because load imposed at one common intersection of ribs is perfectly and evenly disbursed to 6 adjacent ribs.

As was mentioned above, the equilateral triangle 34 grid improves the performance of the tile 10. Specifically, the triangles 34 improve the ability of the tile to disperse load without warping—especially heavy point loads and rolling loads. The load is dispersed by the respective ribs which are disposed in three different orientations which are evenly spaced from one another. This enables the tile 10 to perform better and last longer than conventional tiles.

Figures 3, 3A:
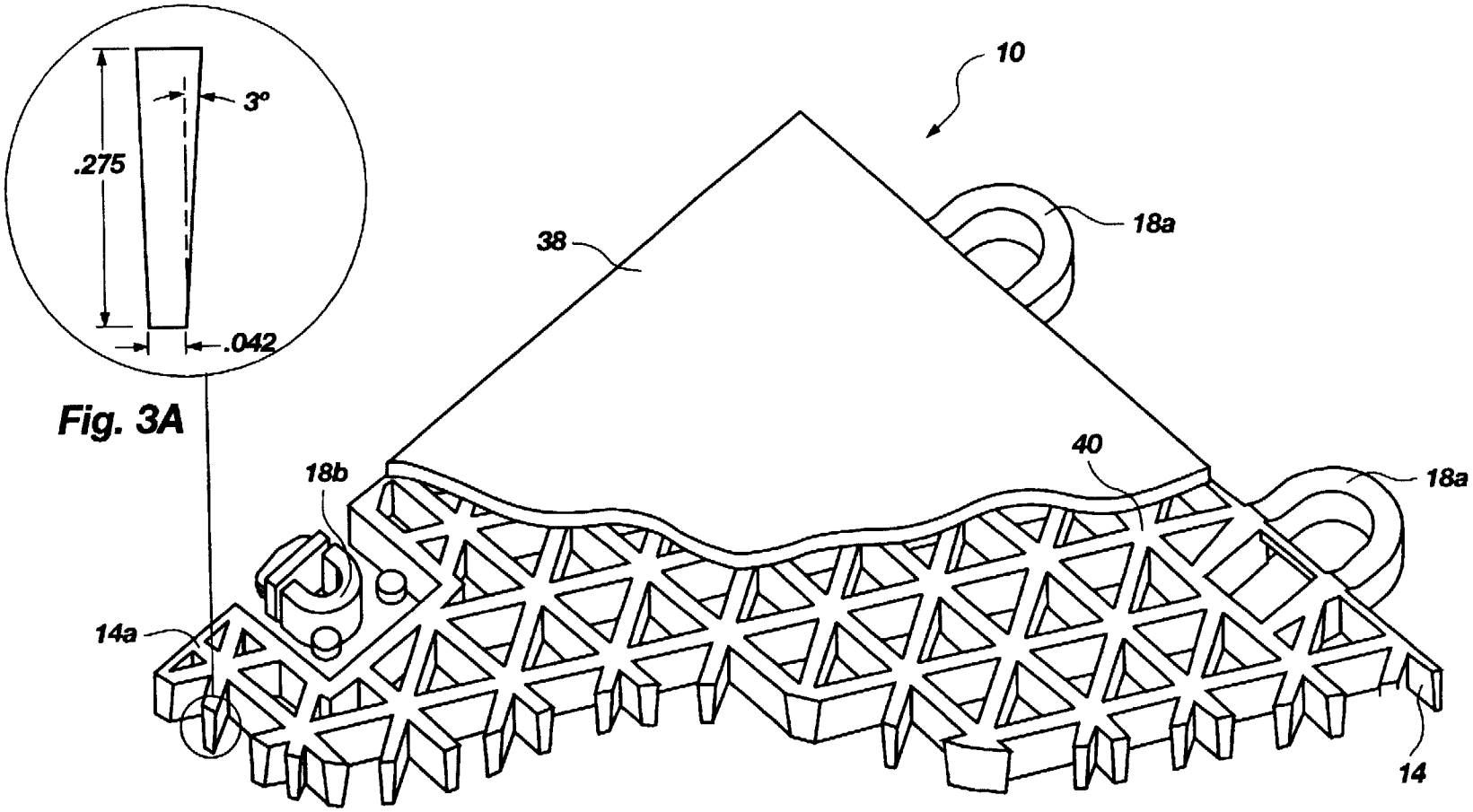
FIG. 3 shows a cut-away view of the flooring tile with a flat surface layer disposed thereon in accordance with one aspect of the invention.

Referring now to FIG. 3, there is shown a top, cut-away view of the tile 10. The flat surface member 38 is cut-away to show the first, second and third pluralities of ribs 22, 26 and 30, forming a common point of intersection, such as that indicated at 40. Also shown is the top portion **14*a* of the wall 14. The thickness of the flat surface member 38 can be varied for the particular use to which the floor tile 10 will be subjected. A typical thickness, however, is about 0.080 inches. The equilateral triangle grid formed by the respective pluralities of ribs, 22, 26 and 30 supports the flat surface layer 38 and distributes load placed on the surface layer when the floor tile 10** is used as part of a modular floor assembly.

Figure 4:
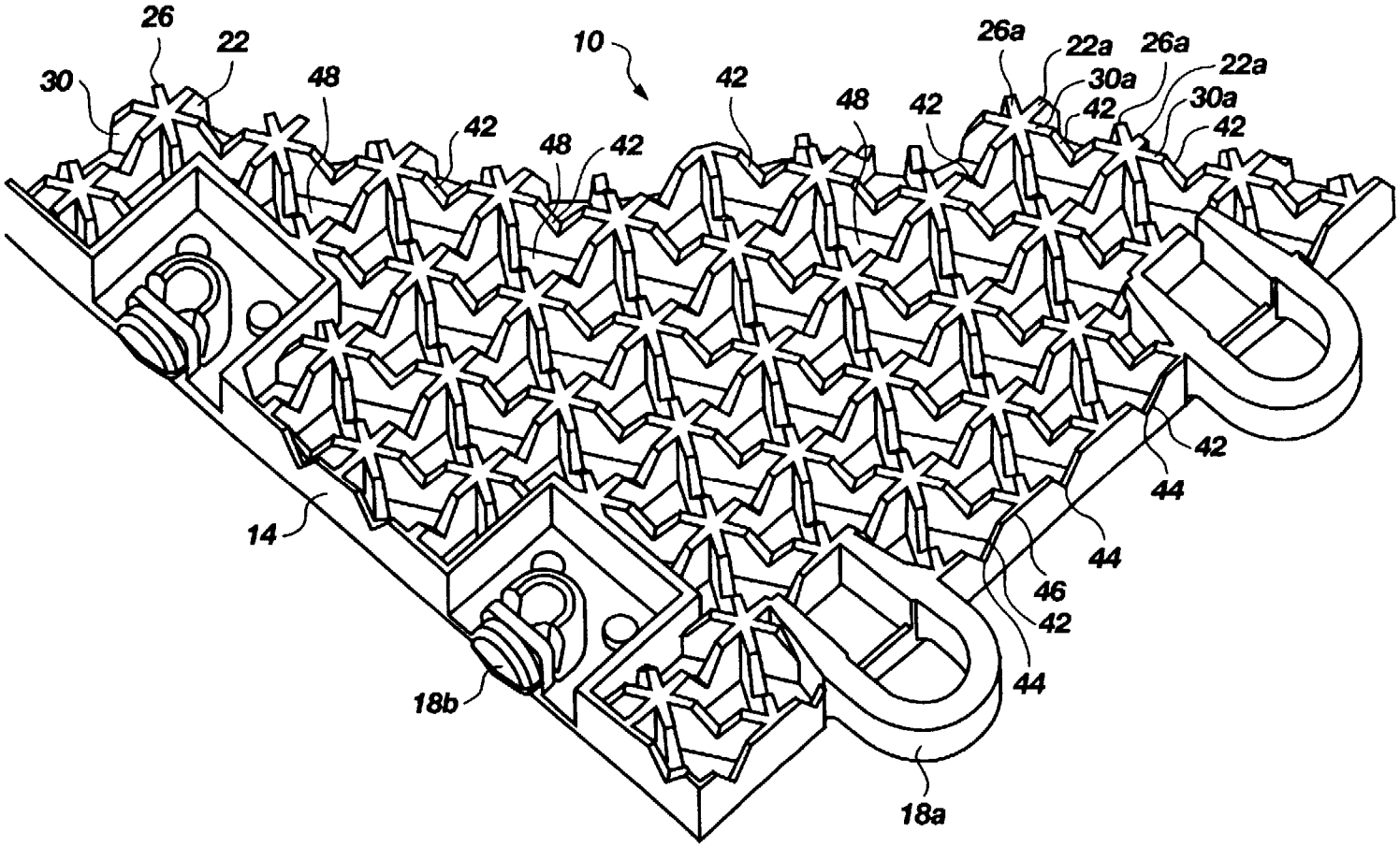
FIG. 4 shows a side perspective view of the flooring tile revealing drainage channels formed in the ribs of the flooring tile.

Referring now to FIG. 4 there is a view of the flooring tile 10 positioned so as to expose a plurality of ports 42 (only some of which are indicated) in the ribs 22, 26 and 30, as well as in the exterior wall 14. The ports 42 are positioned along a bottom edge 46 of the wall 14, and are similarly situated on a bottom edges of the ribs, **22*a*, 26*a* and 30*a*, respectively. The ports 42 provide flow channels to enable drainage from the tile 10. Those familiar with such flooring assemblies will appreciate that the tiles are often used outside, or in locations (such as around swimming pools) where the tiles are subject to moisture. As moisture falls into the triangular shaped chambers, such as are indicated at 48, which are formed within the tile 10**, the water is not able to drain, unless the tile is placed on a porous surface.

To overcome these concerns, the ports 42 are provided in the wall 14 and in the ribs 22, 26 and 30, respectively, to provide a drainage path for water, etc., which has fallen into the triangular shaped chambers 48. The ports 42 may be positioned along the wall 14 and ribs 22, 26 and 30 to provide drainage in any direction, or they may be disposed to limit the direction in which drainage is desired. As shown in FIG. 4, the ports 42 can be formed in the shape of an inverted "V". This maximizes height of the port 42 while limiting the decrease in mass of the tile 10. As was discussed earlier, having sufficient mass in the tile helps to prevent warping.

Figure 5:
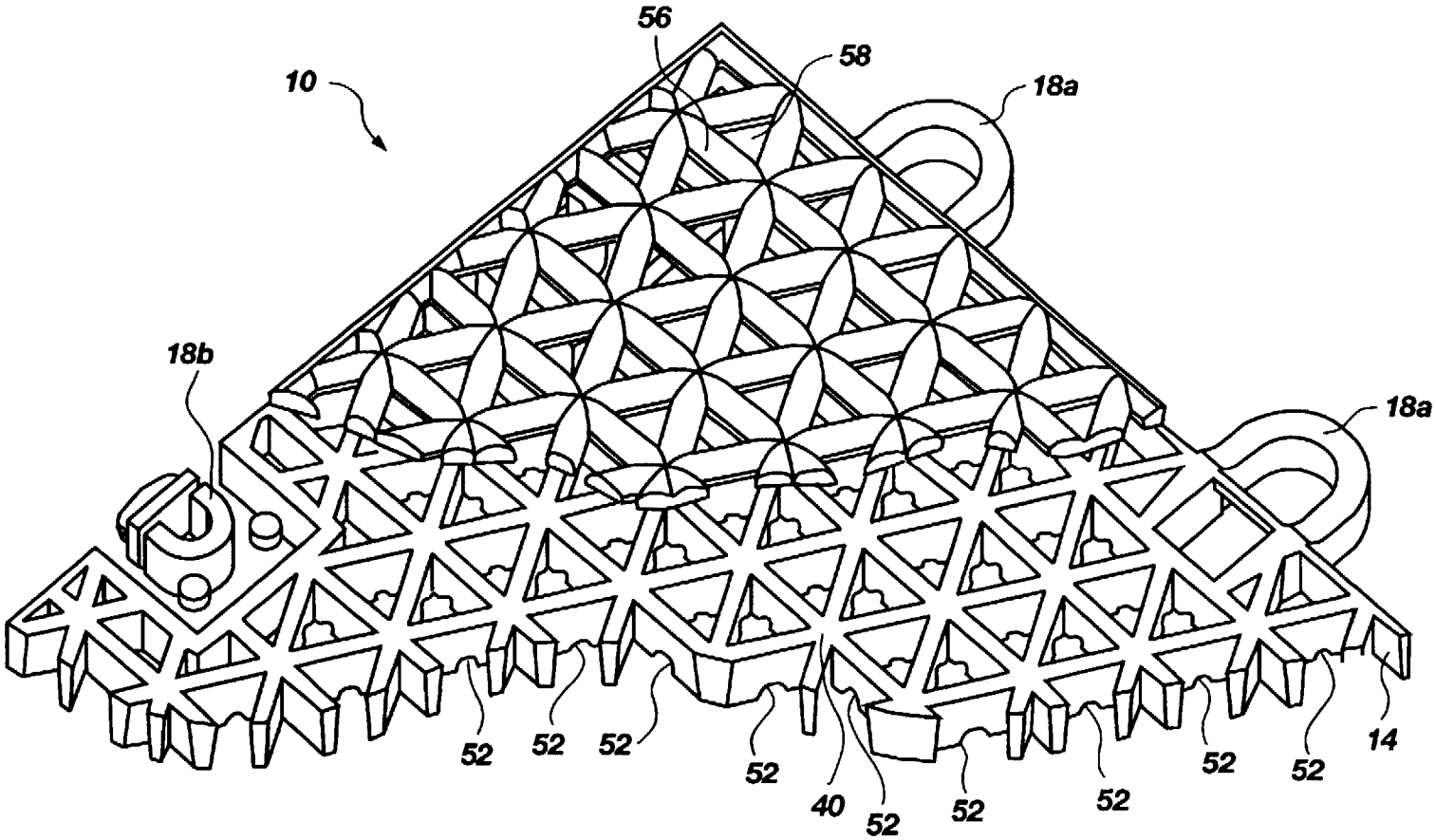
FIG. 5 shows a side view of the flooring tile showing an alternate manner of forming drainage channels in the flooring tile.

Referring now to FIGS. 4 and 5, there is shown an alternate embodiment of the present invention. The flooring tile 10 is substantially the same as that disclosed in FIG. 4 and is numbered accordingly. However, instead of the ports 42 (FIG. 4), there are a plurality of curvatures 52 formed in the wall 14 and in each plurality of ribs 22, 26 and 30, respectively. The curvatures 52 are shown as being circular, but they may be of any suitable curvature.

While the curvatures 52 decreases the mass of the tile 10 slightly more than the ports 42 shown in FIG. 4, they are beneficial in that their shape is better at dispersing the load to which the tile 10 is subjected when in use. Specifically, the ports 42 shown in FIG. 4 tend to centralize the stress of the load at the top point 44. This centralizing of the stress can lead to premature warping or other failure in the tile 10. In contrast, the curvatures 52 are better able to disperse the stress over a greater area, and the tile is thereby less prone to warp or otherwise fail.

Also shown in FIG. 5 is a surface member 56 which is disposed above the isogrid formed by the first, second and third pluralities of ribs, 22, 26 and 30, respectively. The surface member 56 has a plurality of apertures 58 in the shape of equilateral triangles formed therein.

Figure 6:
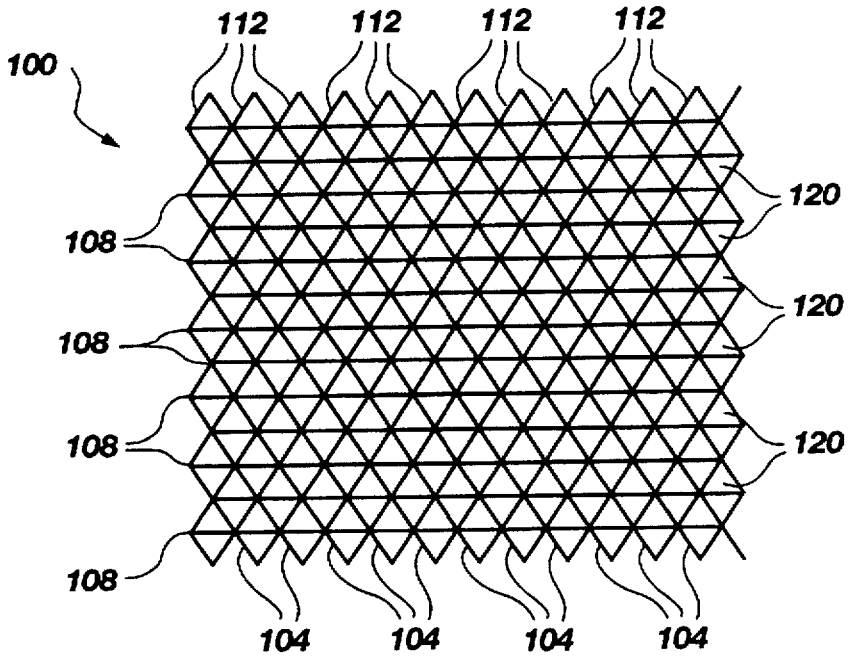
FIG. 6 shows a perspective view of a flooring tile formed in accordance with an alternate embodiment of the present invention.

Referring now to FIG. 6, there is shown an alternate embodiment of a flooring tile, generally indicated at 100, made in accordance with the present invention. Rather than have an exterior wall, such as wall 14 in FIGS. 1–5, the embodiment uses the first plurality of elongate ribs 104, the second plurality of elongate ribs 108 and the third plurality of elongate ribs 112 to form the entire grid of the tile 100. Thus, instead of a generally linear sidewall, such as wall 14 in FIGS. 1–5, the first, second and third plurality of ribs, 104, 108 and 112, respectively connect to form the perimeter of the tile 100.

Figure 7:
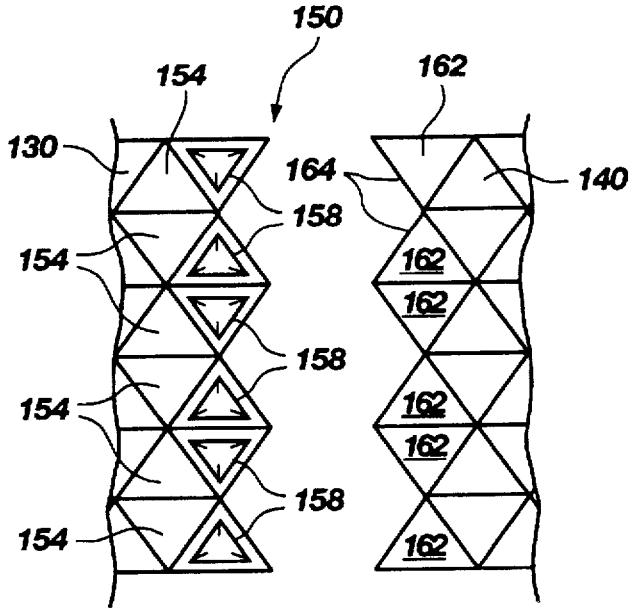
FIG. 7 shows a close-up view of adjacent lateral edges of two flooring tiles similar to that shown in FIG. 6, so as to show the attachment mechanism used to seam the tiles to one another.
Figure 7A:
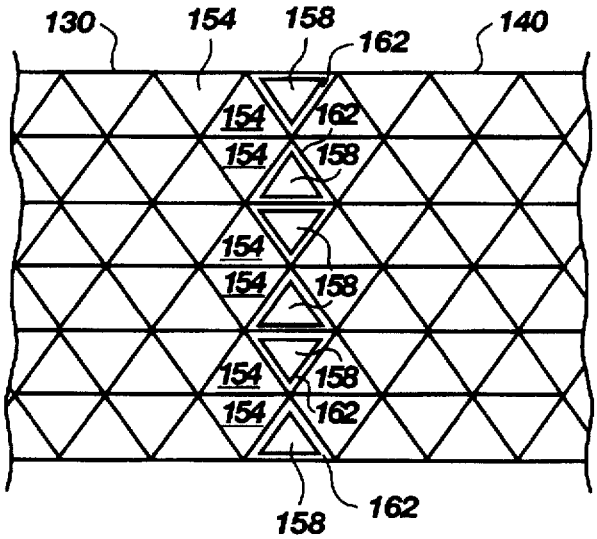
FIG. 7A shows the flooring tiles of FIG. 7 attached to one another.
Figure 7B:
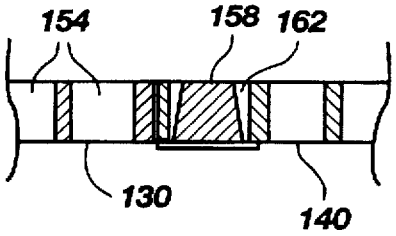
FIG. 7B shows a cross-sectional view of the tiles of FIG. 7A.

The pluralities of ribs 104, 108 and 112, form a plurality of equilateral triangles along each side of the tile 100, such as those identified at 120. The equilateral triangles 120 can then be disposed so as to mesh with equilateral triangles disposed along the perimeter of another flooring tile as shown in FIG. 7. Each flooring tile 100 could have an attachment device disposed between the exterior equilateral triangles 120 to nest within the perimeter triangles of another tile. Typically, the attachment device would be made of a resilient, rubber-like material to help absorb sudden changes in force in a similar manner to the positioning loop **18*a* and the resilient insert 18*b* discussed regarding FIG. 1**. In such a manner, an entire floor assembly could have dispersion of load between tiles based on the principles of the present invention, rather than dispersion on a tile by tile basis.

Referring now to FIG. 7, there is shown a close-up, fragmented view of two tiles 130 and 140 disposed adjacent one another. Each tile has an undulated edge, generally indicated at 150 formed by the equilateral triangles 154 disposed along that edge. Attached to the triangles 154 and extending generally vertically are posts 158 which are disposed so as to nest within the voids 162 formed within the outermost triangles 164 of the adjacent tile.

Typically, the posts 158 will have a triangular perimeter to nest snugly within the outermost equilateral triangles 164 of the other tile. The posts 158 will typically be made of a resilient or semi-resilient material which will provide a small amount of give between the tiles. To nest properly, the triangular posts 158 will also typically have a 3 degree inward taper from the bottom of the post to the top, to compensate for the 3 degree outward draft of the ribs discussed above. Those skilled in the art will appreciate, in light of the present disclosure, that the meshed attachment which is formed between the tiles 130 and 140 is better able to disperse load in numerous directions than are conventional attachment arrangements in which the two tiles have parallel sidewalls. This is especially true when a point or rolling load is placed on the attachment between the two tiles 130 and 140. The overlapping arrangement allows the load to be dispersed, and prevents warping and other damage to the tiles better than those of the prior art.

Figure 8:
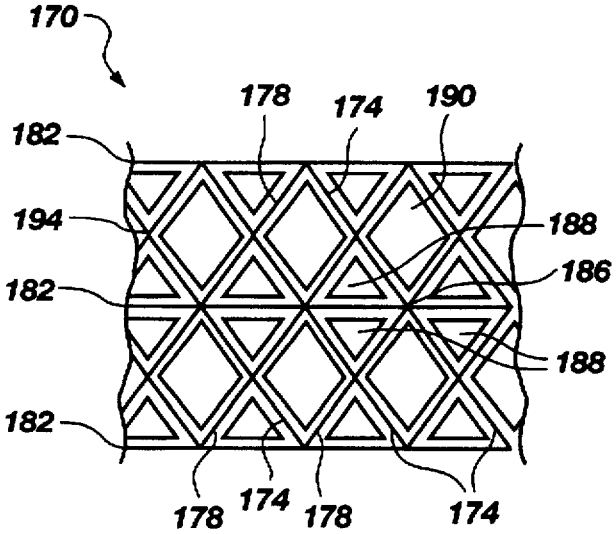
FIG. 8 shows a fragmented view of an alternate embodiment of a flooring tile formed in accordance with the teachings of the present invention.

Referring now to FIG. 8, there is shown a fragmented view of a tile, generally indicated at 170, made in accordance with the teachings of the present invention. The tile is formed of a first plurality of generally parallel ribs 174, a second plurality of generally parallel ribs 178, and a third plurality of generally parallel ribs 182. Unlike the embodiments discussed above, the ribs of each plurality are not evenly spaced apart. Specifically, the ribs of the third plurality 182 are spaced apart twice as far as the ribs of the first plurality 174 and the second plurality 178.

The increased spacing of the third plurality of ribs 182 provides a tile which forms both equilateral triangles and parallelograms between the walls. Specifically, at each point where the first, second and third plurality of ribs, 174, 178 and 182, respectively, intersect, the point of intersection 186 is bordered by four equilateral triangles 188 and two parallelograms 190. At points where only the first plurality 174 and the second plurality 178 intersect, such as point 194, the intersection will be bordered by two equilateral triangles 188 and two parallelograms 190. This is in contrast to the embodiments discussed with respect to FIGS. 1 through 7 in which the intersection of the three pluralities (22, 26 and 30 FIG. 1) is bordered by six equilateral triangles.

Thus, there is disclosed an improved tile for flooring assemblies. The isogrid tile uses ribs forming a plurality of equilateral triangles to more evenly distribute load caused when using the floor. The equilateral triangular grid also allows thinner tiles to be used while retaining the same overall mass as conventional tiles.

Those skilled in the art will recognize numerous obvious modifications which can be made without departing from the scope and spirit of the present invention. The appended claims are intended to cover such modifications.

What is claimed is:

1. An isogrid tile for forming a floor covering above a support floor, the isogrid tile comprising:

a first plurality of generally parallel ribs disposed in a first orientation;

a second plurality of generally parallel ribs disposed in a second orientation transverse to the first plurality of ribs so as to intersect the first plurality of ribs; and a third plurality of generally parallel ribs disposed in a third orientation transverse to the first plurality of ribs and the second plurality of ribs, so as to intersect the first and second plurality of ribs to form a plurality of common points of intersection, each common point of intersection being bordered by at least four equilateral triangles defined by the ribs, wherein the first, second and third pluralities of ribs are disposed in a common plane, thereby forming a tile with a traffic bearing surface, and wherein at least one of the pluralities of ribs has a base portion for resting on the support floor.

2. The isogrid tile of claim 1, wherein the second orientation is offset from the first orientation approximately 60 degrees and wherein the third orientation is offset from the second orientation 60 degrees.

3. The isogrid tile of claim 1, wherein the ribs of the first plurality are spaced apart from one another between one-fourth and three-fourths of an inch, and wherein the ribs of the second plurality are spaced apart from one another between one-fourth and three-fourths of an inch.

4. The isogrid tile of claim 3, wherein the ribs of the third plurality are spaced apart from one another between one-fourth and three-fourths of an inch.

5. The isogrid tile of claim 3, wherein each plurality of the ribs are spaced apart within the approximate range of two-fifths to three-fifths of an inch.

6. The isogrid tile of claim 1, further comprising a flat surface member disposed above and formed integrally with the ribs such that the ribs support the flat surface member with an isogrid support structure defining a plurality of equilateral triangles.

7. An isogrid tile for forming a floor covering, above a support floor, the isogrid tile comprising:

a first plurality of generally parallel ribs disposed in a first orientation;

a second plurality of generally parallel ribs disposed in a second orientation transverse to the first plurality of ribs so as to intersect the first plurality of ribs; and a third plurality of generally parallel ribs disposed in a third orientation so as to intersect the first plurality of ribs and the second plurality of ribs such that the first, second and third pluralities of ribs form a plurality of equilateral triangles in the tile adjacent points of intersection of the first, second and third plurality of ribs, wherein the first, second and third pluralities of generally parallel ribs are disposed in a common plane to form a tile with a traffic bearing surface, and wherein the ribs have an upper edge disposed adjacent the traffic bearing surface, and at least one of the first, second and third plurality of ribs has a base for engaging the support floor.

8. The isogrid tile of claim 7, wherein the second orientation is offset from the first orientation approximately 60 degrees, and the third orientation is offset from the first and second orientations, respectively, approximately 60 degrees, the first, second and third pluralities of ribs being disposed in a common plane.

9. The isogrid tile of claim 7, wherein the first plurality of ribs are spaced apart less than one inch from adjacent ribs of the first plurality.

10. The isogrid tile of claim 9, wherein the first plurality of ribs are spaced between one-fourth and three-fourths of an inch from one another.

11. The isogrid tile of claim 7, wherein each rib comprises an upper edge adjacent a traffic bearing surface of the tile, a lower edge adjacent to a support face, and wherein a plurality of ports are formed in the ribs adjacent the lower edge so as to form a plurality of channels for draining fluid entering the equilateral triangles defined by the ribs.

12. A floor covering assembly including at least a first and second tile, each tile being formed in accordance with claim 7, and wherein the first and second tile further comprise;

attachment means disposed along a perimeter of each tile for connecting said first and second tiles together.

13. The floor covering assembly of claim 12, wherein the attachment means comprises a plurality of rounded couplings extending from the perimeter of the first tile and a plurality of resilient inserts disposed along a perimeter of the second tile for nesting in rounded couplings of the first tile.

14. The floor covering assembly of claim 12, wherein the attachment means includes a plurality of equilateral triangles formed along the perimeter of the first tile by the first, second and third plurality of ribs.

15. The floor covering assembly of claim 14, wherein the attachment means further comprises a plurality of posts attached to the perimeter of the second tile and extending generally vertically for nesting within equilateral triangles disposed along the perimeter of the first tile.

16. The floor covering assembly of claim 15, wherein the posts of the second tile have a generally triangular perimeter for nesting within the equilateral triangles disposed along the perimeter of the first tile.

17. A method for forming a floor covering assembly configured for uniformly dispersing load, the floor covering assembly being positioned above a support floor, the method comprising:

(a) connecting a plurality of tiles, each tile having intersecting ribs disposed so as to form a plurality of equilateral triangles;

(b) positioning the connected plurality of tiles on the support floor.

18. A method according to claim 17, wherein the method comprises, more specifically:

forming a plurality of equilateral triangles along lateral edges of two or more tiles; and adjoining at least two of the tiles by intermeshing the equilateral triangles of respective tiles.

* * * * *